US006864467B2

(12) United States Patent
Stritzinger et al.

(10) Patent No.: US 6,864,467 B2
(45) Date of Patent: Mar. 8, 2005

(54) HEATER FOR GASEOUS MEDIA

(75) Inventors: Jürgen Stritzinger, Freckenfeld (DE); Norbert Kern, Kandel (DE)

(73) Assignee: Eichenauer Heizelemente GmbH & Co. KG, Kandel (DE)

( * ) Notice: Subject to any disclaimer, the term of this patent is extended or adjusted under 35 U.S.C. 154(b) by 0 days.

(21) Appl. No.: 10/702,504

(22) Filed: Nov. 7, 2003

(65) Prior Publication Data

US 2004/0091250 A1 May 13, 2004

(30) Foreign Application Priority Data

Nov. 9, 2002 (DE) ..... 202 17 309

(51) Int. Cl.[7] ..... H05B 3/02

(52) U.S. Cl. ..... 219/546; 219/536; 219/552; 338/282; 338/304; 338/305

(58) Field of Search ..... 219/546, 548, 219/552, 536; 338/282, 291, 297, 304, 305, 315, 321

(56) References Cited

U.S. PATENT DOCUMENTS

| | | | | | |
|---|---|---|---|---|---|
| 3,119,087 | A | * | 1/1964 | Scribner | 338/62 |
| 4,209,686 | A | * | 6/1980 | Moglia et al. | 338/301 |
| 4,230,933 | A | * | 10/1980 | Glucksman et al. | 338/302 |
| 4,238,756 | A | * | 12/1980 | Immel | 338/304 |
| 4,313,049 | A | * | 1/1982 | Meywald et al. | 219/532 |
| 4,350,872 | A | * | 9/1982 | Meywald et al. | 338/299 |
| 4,458,141 | A | * | 7/1984 | Howard et al. | 219/532 |
| 4,667,086 | A | * | 5/1987 | Keefe | 219/532 |
| 4,692,599 | A | * | 9/1987 | Howard et al. | 219/532 |
| 4,956,545 | A | * | 9/1990 | Ohnmacht et al. | 219/541 |
| 5,298,723 | A | * | 3/1994 | Philpot | 219/532 |
| 6,732,450 | B1 | * | 5/2004 | Chen | 34/96 |

FOREIGN PATENT DOCUMENTS

| | | | |
|---|---|---|---|
| DE | 27 05 526 | 6/1970 | H05B/3/24 |
| DE | 25 31 854 | 1/1977 | H05B/3/16 |
| DE | 25 35 478 | 2/1977 | F24C/7/06 |
| DE | 27 05 526 | 1/1978 | H05B/3/26 |
| DE | 26 44 093 | 4/1978 | H05B/3/26 |
| DE | 27 03 717 | 8/1978 | H05B/3/22 |
| DE | 28 02 685 | 7/1979 | H05B/3/26 |
| DE | 28 30 532 | 1/1980 | H05B/3/26 |
| DE | 30 14 935 | 10/1981 | H05B/3/26 |
| DE | 195 05 930 | 8/1996 | H05B/3/16 |
| EP | 0 352 556 | 1/1990 | H05B/3/26 |

* cited by examiner

*Primary Examiner*—Robin O. Evans
*Assistant Examiner*—Vinod Patel
(74) *Attorney, Agent, or Firm*—Antonelli, Terry, Stout & Kraus, LLP

(57) ABSTRACT

An electric heater for gaseous media with at least one support plate and at least one helix of corrugated, electric resistance heating wire wound continuously around the support plate and whose turns are held by means of heating wire bend-offs on the longitudinal edges of the support plate is characterized in that the heating wire is positioned in such a way that it only contacts longitudinal narrow sides and/or edges of the longitudinal narrow sides of the support plate, the bending angle being much larger than 40°. This significantly reduces the risk of thermal damage to the heating wire, particularly in the vicinity of the plate edges. As a result of the largely naturally stable design of the heating wire, the heater according to the invention requires no spacers between the support plates and is therefore particularly simple and inexpensive to manufacture.

20 Claims, 6 Drawing Sheets

HEATER FOR GASEOUS MEDIA

FIELD OF THE INVENTION

The invention relates to an electric heater for gaseous media having at least one support plate and at least one coil of a corrugated, electric resistance heating wire, which is continuously wound around the support plate and whose turns are held on the longitudinal edges of the support plate by bend-offs of the heating wire.

BACKGROUND OF THE INVENTION

DE 18 05 639 discloses a heater, where a heating wire is wound around one or two parallel, elongated support plates in the form of insulating material plates, the heating wire being pressed with the aid of a press on both sides against the edges of the insulating material plates in such a way that deflections occur embracing the plate edges in clip or clamp-like manner. A disadvantage of this construction is that in the vicinity of said clip-like deflections and as a result of its engagement on the insulating material plates, the heating wire becomes too hot and starts to glow, which greatly decreases the service life. Relative to the longitudinal extension of the insulating material plates, the heating wire also does not have an adequate length in order to provide a high heating power.

Thus, DE 26 44 093 proposes winding the heating wire helically about a single support plate, the heating wire being uniformly corrugated over its entire length so as in this way to obtain a greater heating wire length. In order to ensure the necessary stability of the heating wire, also in this construction the heating wire comes in the vicinity of the plate edges into clip-like contact with the support plate, the contact length being further increased compared with the disclosure of DE 18 05 639, which also gives rise to the aforementioned disadvantages.

Thus, in the known heaters, where a higher heating power was required, e.g. in DE 25 35 478 and DE 195 05 930 it has been proposed to pass the tips of a substantially zig-zag-shaped heating wire through openings in two support plates parallel to one another. However, this gives rise to the disadvantage that at the reversal points or tips of the wire, as a result of the lower air flow rate at these points, an overheating and glowing of the wire can occur. In addition, in the case of such known heaters it is considered disadvantageous that the heating wire takes up all the space between the support plates and it is consequently impossible to place a temperature or thermal element centrally between said support plates. In addition, with such a construction and as a result of the aforementioned circumstances, it is difficult to provide a return conductor in the vicinity of the plates in the case of one-sided electrical terminals for the heater. A further disadvantage is the complicated and therefore relatively expensive manufacture of such heaters.

The problem of the invention is to provide an electric heater according to the preamble having an adequate heating wire length for generating and giving out the necessary heating power, the heating wire heating in a relative uniform manner over its entire length so as in this way to avoid points with excessive heating, so that the heater according to the invention has a long service life. The construction is intended to be particularly suitable for heaters through which there is a transverse flow.

SUMMARY OF THE INVENTION

In the case of an electric heater for gaseous media of the aforementioned type, the set problem is solved in that the heating wire is positioned in such a way that it is only in contact with longitudinal narrow sides and/or edges of the longitudinal narrow sides of the support plate and is guided over the longitudinal narrow sides of the support plate in the vicinity of a convex bend-off, the bending angle between heating wire areas following onto the bend-off on both sides exceeds 40°. This statement obviously refers to the bend-offs engaging on the longitudinal edges and the adjacent areas in the heating wire state when it is supported by a support plate. Preferably the bending angle significantly exceeds 40°, e.g. exceeds 60°. In another preferred development the bending angle is under 120°, so that in an extremely preferred development it is approximately 90 to 100°. This prevents an areal engagement of the heating wire on the support plates in the vicinity of their edges, so that at this point there is no overheating and consequently no damage to the heating wire.

According to a further development of the heater according to the invention, the heating wire, e.g. at regular intervals and in addition to the straight flanks positioned between wave peaks and corresponding wave troughs has further, straight portions with a greater length than the flanks. Preferably said straight portions are at least twice as long as the flanks. Thus, after passing round the longitudinal narrow side of the support plate, in its further course the heating wire moves increasingly away from the outside thereof, so that overheating is effectively prevented. This is particularly advantageous with heaters through which there is a transverse flow.

In order to ensure simple manufacture, when using several parallel support plates, the inventive heater should not require spacers or the like between the support plates and also should not require fixing devices for fixing the heating wire to the support plates. For this purpose and in a highly preferred development of the inventive heater, the straight portions extend substantially tangentially to the turns of the coil, so that in transition areas between straight and corrugated portions, the heating wire is held on the longitudinal edges of the support plates. Thus, the support plates are fixed in their relative position by the heating wire, so that advantageously there is no need for additional spacers between the plates.

In another preferred development of the heater according to the invention, when using a plurality of support plates, in an area between said support plates the heating wire has a regular wave pattern of wave peaks and troughs. Thus, in said area the heating wire acquires (natural) stability and also has a greater length compared with a straight course and this improves the heat emission.

According to a further development of the inventive heater, between straight portions engaging on facing longitudinal narrow sides, the heating wire has at least one further wave trough, whose apex engages on an outside of the support plate. As a result of the heating wire engaging in solely punctiform manner on the support plate, the inventive heater acquires additional stability, without any deterioration in the thermal characteristics.

Alternatively or additionally, according to a particularly preferred development of the inventive heater, between straight portions engaging on facing longitudinal narrow sides, the heating wire has two wave troughs and in a portion between the same the heating wire has a substantially M-shaped configuration. Preferably the heating wire is at no point in contact with the outside of the support plate. With such a construction a significant heating wire length is ensured without any risk of local overheating and consequently there is an optimum utilization of the available space.

According to a further development of the heater according to the invention, it has a double or multiple coil in the form of at least two, parallel wound heating wires. This makes it possible to produce different heating stages, so that the inventive heater can be used in a particularly flexible manner. Alternatively or additionally this can also be brought about by intermediate taps along the heating coil.

According to a further development of the heater according to the invention, when using several support plates in an area between the latter is provided a thermal element. Such a thermal element can react particularly rapidly and sensitively to a thermal state of the inventive heater and also contributes to an optimum utilization of the available space.

To secure the heating wire of the inventive heater against lateral displacement, the longitudinal narrow sides of the support plate can have grooves for the insertion of heating wire windings.

In conjunction with a further development of the inventive heater it is possible for the support plate to have openings in the vicinity of the coil. This firstly aids the bringing about of a turbulent flow desirable for improved heat dissipation purposes and secondly in the vicinity of such an opening can be located the above-described thermal element.

The heating wire of the inventive heater preferably has a PTC characteristic, which with rising temperatures leads to an increase in the resistance of the heating wire. This makes it possible to provide a self-regulating temperature protection when high initial power levels occur. A combination of a conventional heating wire and a PTC heating wire, particularly with a parallel winding of the two wires, is also suitable for limiting the high initial power and therefore the current.

In an extremely preferred further development of the inventive heater it has a number of heating wire windings per length unit which is variable along the support plate. Thus, it is possible for the number of turns over the entire turn length not to be constant and instead can be made variable so as to adapt to the flow conditions. This is particularly advantageous with a tangential blower or fan, because over the heater length there are different flow rates of the gaseous medium.

In order to be able to adapt the heating resistor of the inventive heater to the given requirements in conjunction with flexible manufacture, the electrical resistance of the heater is to be adaptable by means of the particular depth of the wave troughs or height of the wave peaks.

In conjunction with an optimum utilization of the available space, according to a further development of the inventive heater the latter has a return conductor which passes between the support plates. Preferably the two connection sides for the thermal element are formed by the return conductor.

BRIEF DESCRIPTION OF THE DRAWINGS

Further advantages and features can be gathered from the claims and the following description of embodiments of an inventive heater relative to the attached drawings, wherein show:

DETAILED DESCRIPTION OF THE DRAWINGS

Figure 1A:
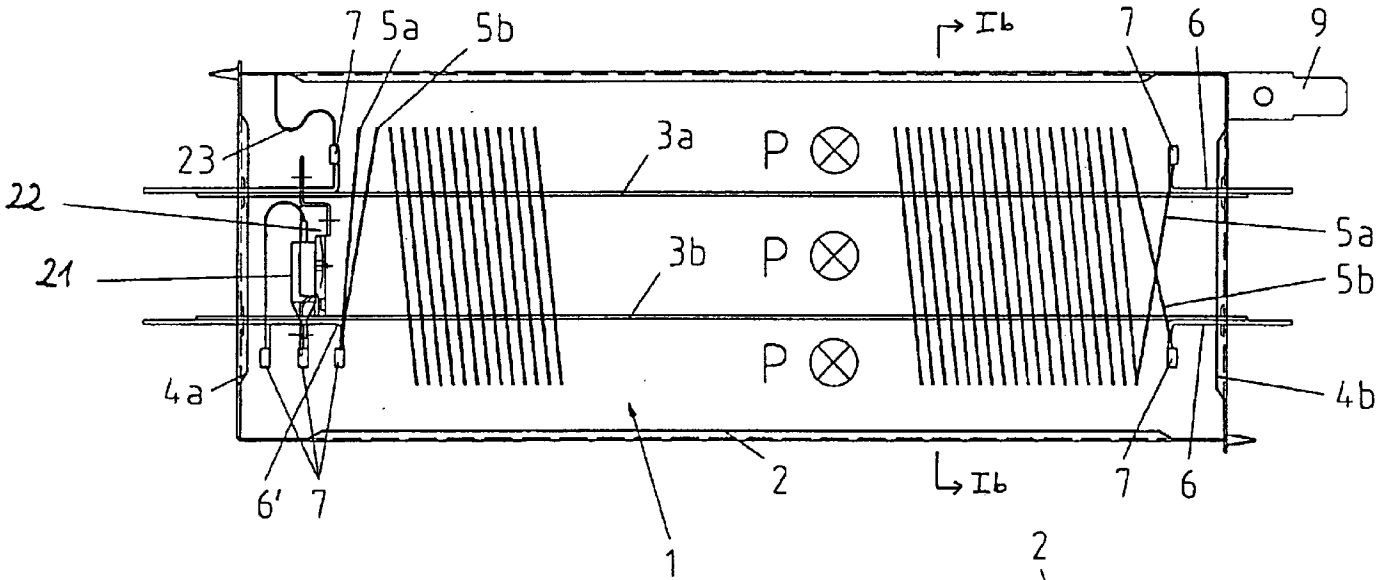
FIG. 1*a* A front view of an inventive heater with a casing with a viewing direction corresponding to the inflow direction of the gaseous medium to be heated.
Figure 1B:
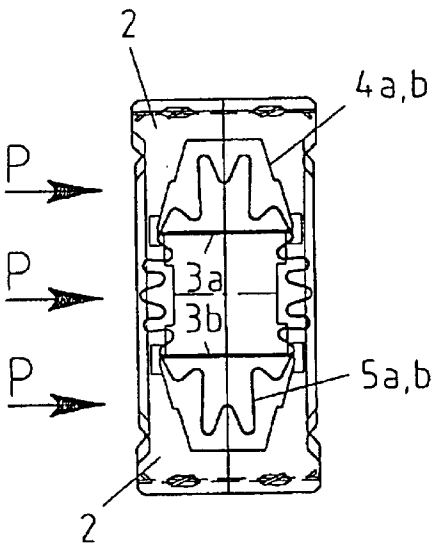
FIG. 1*b* A section through the inventive heater of FIG. 1*a*, corresponding to Ib—Ib.

FIGS. 1*a* and 1*b* are front and sectional views of an electric heater 1 in a cross-sectionally rectangular casing 2 through which passes a flow P of a gaseous medium to be heated such as air and which e.g. passes at right angles to the extension thereof. In the interior of the casing 2 are provided two parallel support plates 3*a*, 3*b* in the form of insulating material plates, which are held in lateral openings 4*a*, 4*b* of the casing 2. In the embodiment shown around the two insulating material plates 3*a*, 3*b* are helically wound in bifilar manner two resistance heating wires 5*a*, 5*b*. However, it is obviously possible for there to be only one or more than two heating wires.

At their ends the heating wires 5*a*, 5*b* are held by contact parts 6, 6*a*, which are fixed to the insulating material plates 3*a*, 3*b* and passed outwards through the lateral openings 4*a*, 4*b* of the casing and simultaneously represent the electric terminals for the heating wires 5*a*, 5*b*.

In an area between the support plates 3*a*, 3*b* is provided a thermal element comprising fuse 21 and temperature sensor 22.

FIG. 1*b* shows in a sectional view corresponding to Ib—Ib in FIG. 1*a* a first winding run of the heating wires 5*a*, 5*b* around the support plates 3*a*, 3*b*. As a result of the natural stability of the heating wires 5*a*, 5*b*, whose special design will be explained in greater detail hereinafter relative to FIGS. 1*c*, 2 and 3*a*, no spacers or the like are required between the support plates 3*a*, 3*b*. In addition, use is made of all the space within the casing 2, so as in this way to make available a high heating power over an increased length of the heating wires 5*a*, 5*b*.

Figure 1C:
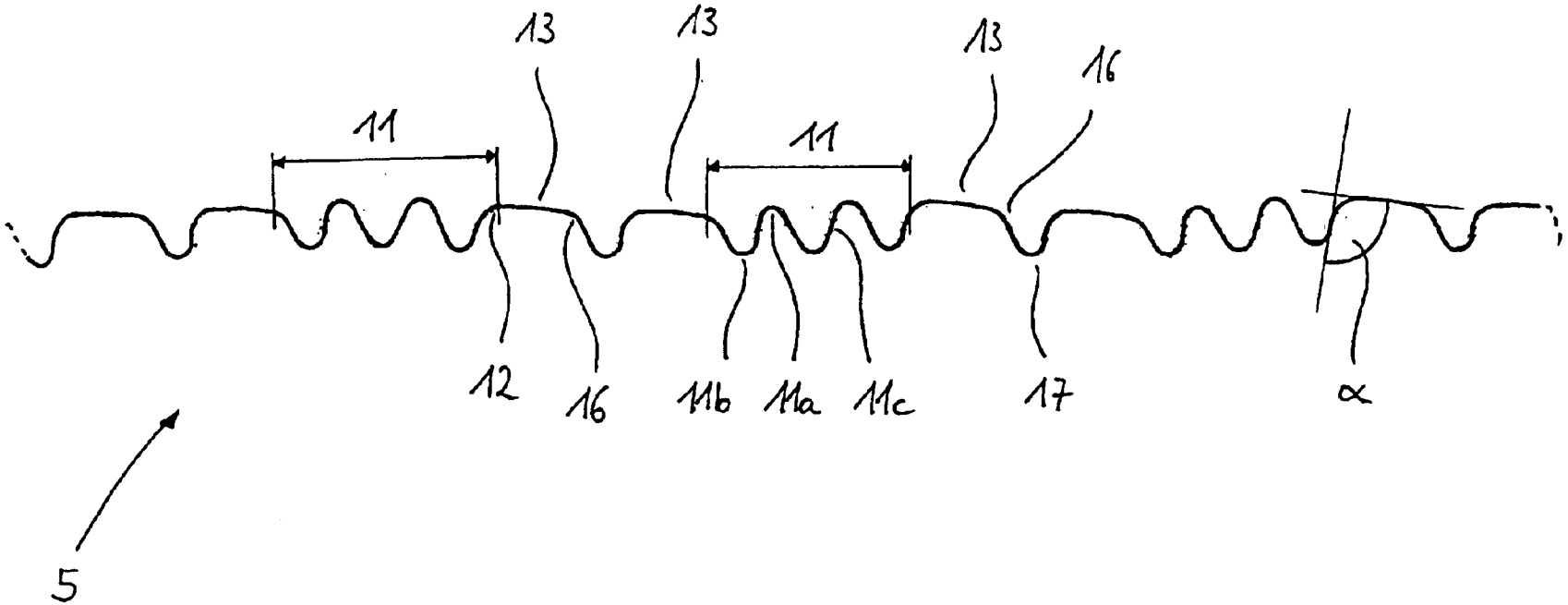
FIG. 1*c* A heating wire of the inventive heater in the unwound state.
Figure 3A:
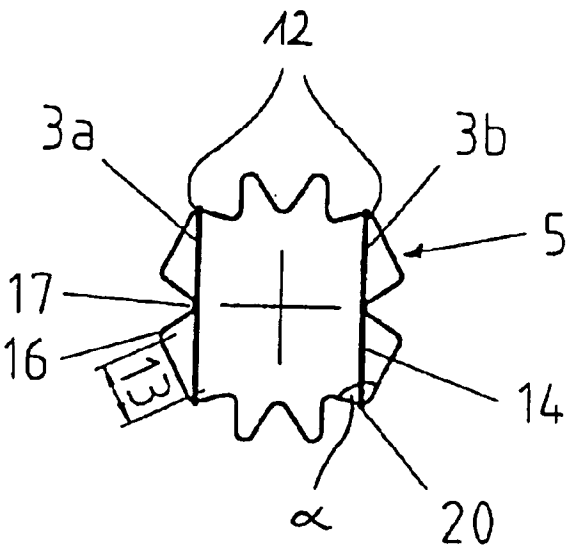
FIG. 3*a* A side view of another inventive heater.

A first embodiment of a heating wire for an inventive heater is shown in FIG. 1*c* (cf. bottom of FIG. 3*a*). The heating wire 5 (shown in detail, unwound form in FIG. 1*c*) has in portions 11 a regular wave pattern of wave peaks 11*a* and wave troughs 11*b*. Between the corresponding apices of the wave peaks 11*a* and wave troughs 11*b* extend substantially straight flanks 11*c*. On either side the portions 11 terminate in a bend-off 12, whose bending angle significantly exceeds 40° and in the embodiment shown is preferably approximately 90°. Here and hereinafter the bending angle is in each case the angle enclosed by the wire flanks, i.e. $\alpha=0°$ in the case of a completely bent wire running back parallel to itself and $\alpha=180°$ for an unbent, straight wire.

Following onto the bend-offs 12 the heating wire is provided at regular, periodic intervals with straight portions 13, which have a greater length compared with the flanks 11*c* (double the length in the embodiment of FIG. 1*c*). Between individual straight portions 13 the heating wire 5 has bend-offs 16, between which in the embodiment shown is provided a further wave trough 17.

Figure 3B:
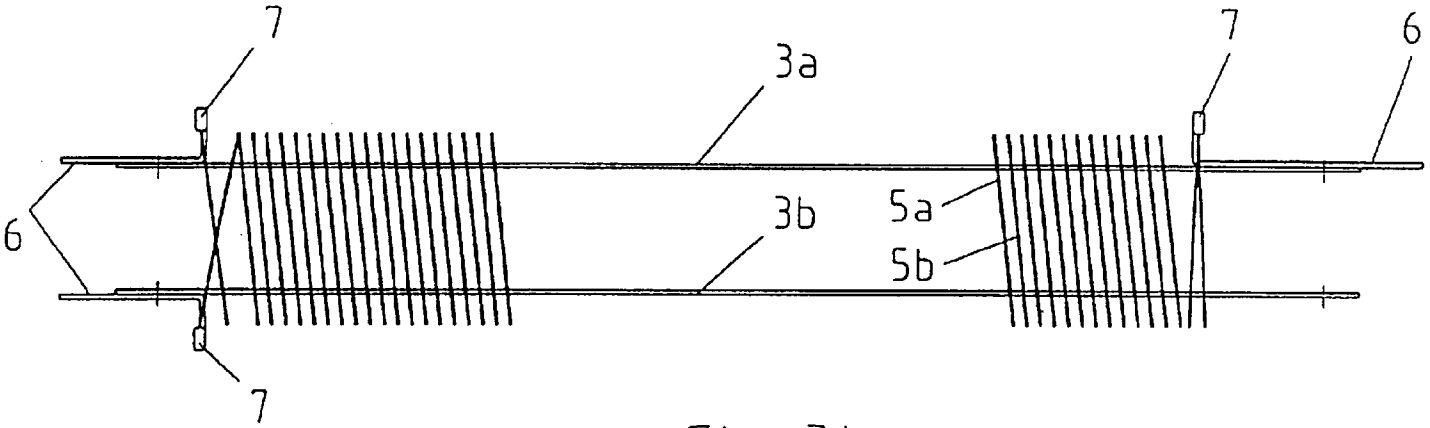
FIG. 3*b* A front view of the heater of FIG. 3*a*.

The aforementioned heating wire 5 described relative to FIG. 1*c* is shown again in the wound up state in FIG. 3*a* and is used in an inventive heater according to FIG. 3*b*.

Figure 2:
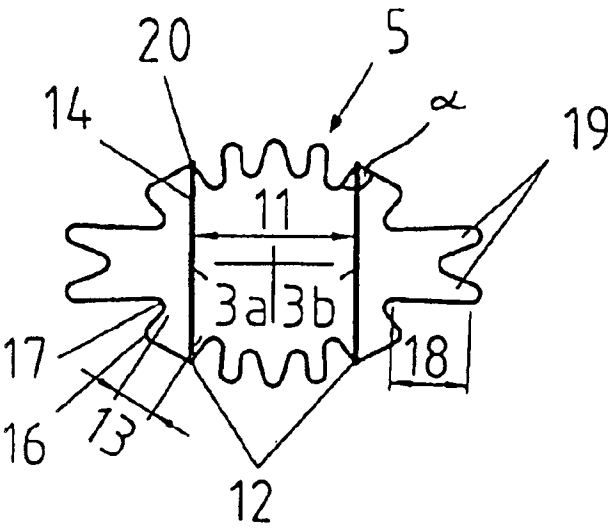
FIG. 2 A side view of support plates provided with heating wire turns.

FIG. 2 is a side view of a turn of a heating wire 5 corresponding to the heating wires 5*a*, 5*b* of FIGS. 1*a* and 1*b* and which differs in parts from the above-explained construction according to FIG. 1*c*. In principle, each individual heating wire turn has the same wave pattern, but different patterns can be implemented. In the wave pattern shown in FIG. 2 the heating wire turn has in portions 11 between the insulating material plates 3*a*, 3*b* a substantially rectangular wave pattern according to FIG. 1*c*, the bend-offs 12 being positioned on the narrow sides 20 of the insulating material plates 3*a*, 3*b*. The bending angle of the bend-off 12 is approximately 100°. The substantially straight portions 13 of the heating wire 5 bilaterally following onto the portions 11 in the vicinity of the outsides 14 of the insulating material plates 3*a*, 3*b* are positioned substantially tangentially to the heating wire winding as a result of the coil shape of the heating wire. As stated, the insulating material plates 3*a*, 3*b* have their narrow sides 20 and edges 20*a* in the convex bend-offs 12 in the transition area between the corrugated portions 11 and the straight portions 13 of the heating wire 5 and therefore, even without a casing, are fixed in their relative position, which significantly facilitates the handling of the heater according to the invention.

The aforementioned classification of the bend-offs of the heating wire 5*a*, 5*b* follows from their relative arrangement with respect to the support plates 3*a*, 3*b*, wherein bend-offs in whose vicinities the wire has a convex course are correspondingly referred to as convex bend-offs. Those bend-offs where the wire course is concave relative to the arrangement of the support plates 3*a*, 3*b* are therefore called concave bend-offs. Specifically the convex or concave bend-offs with a bending angle $0° < \alpha < 180°$ can also be referred to as wave peaks or wave troughs and vice versa (cf. FIG. 1*c*).

In each case the straight portions 13 terminate as in FIG. 1*c* in a further convex bend-off 16, which is followed by a concave bend-off 17 (wave trough). Further straight portions 18 centrally bring together the heating wire 5 in two superelevated wave peaks, the heating wire 5 having a M-shaped configuration in this portion as a result of the wave peaks 19 and the straight portions 18. As a result of the wave pattern in the portions 11 between plates 3*a*, 3*b* the stability of the heating wire arrangement, particularly against transverse forces acting in the direction of the double arrow 11 is ensured, so that the inventive heater 1 according to FIG. 1*a* does not require additional stabilizing elements (spacers).

The above-described construction of the heating wire windings has the advantage that as a result of the straight portions 13 in the vicinity of the outside 14 of plates 3*a*, 3*b* an engagement or approach of the heating wire 5 on or to the outsides 14 of the insulating material plates 3*a*, 3*b* is prevented and instead the heating wire 5 only engages in punctiform manner on the narrow sides 20 and/or their edges 20*a* on plates 3*a*, 3*b*. This reliably prevents an overheating of the heating wire 5 in the marginal area of the plates 3*a*, 3*b*. As a result of the superelevated wave peaks 19, this construction makes optimum use of the space available in casing 2 (cf. FIG. 1*b*). However, the wave pattern can have other constructions adapted to specific requirements and which can also change from winding to winding along the support plates 3*a*, 3*b*.

Thus, FIGS. 3*a* and 3*b* show views of a simpler embodiment of the heating wire turns substantially corresponding to the construction of the heating wire 5 shown in FIG. 1*c*. It is preferably used if the overall height of the casing 2 must be significantly lower for space reasons than in the embodiment of FIG. 2 or 1*b*. The heating wire 5 passes in regular waves between the insulating material plates 3*a*, 3*b*. Once again the narrow sides 20 and/or edges 20*a* of the insulating material plates 3*a*, 3*b* are located in convex bend-offs 12 of the heating wire 5 and are fixed as a result of this (FIG. 3*a*). As in the embodiment of FIG. 2, in the vicinity of the outsides 14 of plates 3*a*, 3*b*, on either side a straight portion 13 follows onto the same, so that the heating wire 5 engages on the insulating material plate edges only in the region of the narrow sides 20 and/or edges 20*a* and consequently overheating of the wire 5 in this area is prevented. As in FIG. 2, the straight portions 13 are bilaterally followed by further convex bend-offs 16, which bring together centrally and corresponding to FIG. 1*c*, the heating wire 5 in a single, concave bend-off 17 (wave trough), engaging with its apex in punctiform manner on the outsides 14 of plates 3*a*, 3*b*.

No overheating of the heating wire 5 need be feared as a result of the distance from the plate edges. Through the bearing of the heating wire 5, both the insulating material plates 3*a*, 3*b* and the heating wire 5 are better fixed.

Also in the embodiment of FIG. 3*a* the bending angle $\alpha$ of the bend-off 12 is approximately 100°.

Figure 4:
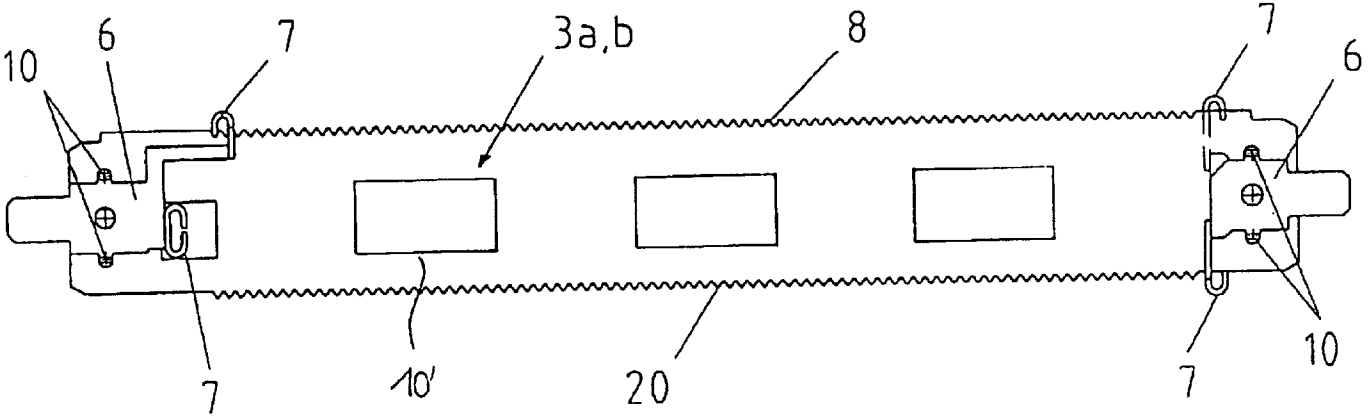
FIG. 4 A plan view of a support plate of an inventive heater.

FIG. 4 is a plan view of the insulating material plates 3*a*, 3*b* of the inventive heater 1. In this exemplified embodiment grooves 8 are formed on the longitudinal edge of the insulating material plates 3*a*, 3*b* and in the same are inserted during winding the heating wire 5*a*, 5*b* and it is consequently secured against lateral displacement. In the lateral area the plates have openings 10 through which can pass the link plates of contact part 6 and ensure a clamping fixing of the contact part 6 to the plates 3*a*, 3*b*. Further link plates 7 of the contact part 6 hold the ends of the heating wires 5*a*, 5*b*, the fuse 21 and the temperature sensor 22 (FIG. 1*a*).

Central openings 10' are used for giving a turbulent flow behaviour to the medium P flowing through the inventive heater 1, so that an improved heat dissipation is possible. In addition, the thermal element 21, 22 shown in exemplified manner in FIGS. 1*a* and 5 can be positioned in the vicinity of such openings 10' in order to bring about an optimum use of the available space.

Numerous possibilities are provided by the invention regarding the contacting of the heating wires 5, 5*a*, 5*b*. Thus in addition to the two-sided contact arrangement referred to hereinbefore in connection with FIG. 1*a* in the case where the terminals are not located on different sides of the casing, but are instead to be led out on a single side, according to FIG. 1*a* the possibility exist of a return line over the casing 2. For this purpose the left-hand contact part 6' is connected by means of a thermal element comprising fuse 21 and temperature sensor 22, as well as a connecting conductor 23 to the casing 2, so that the current is conducted via the casing 2 to a right-hand terminal 9.

In the embodiment of FIG. 3*b* the electric terminals are bilaterally guided via the contact parts 6, the heating wires 5*a*, 5*b* being held in link plates 7 of the contact part 6. Thermal elements are not shown here (cf. FIGS. 5*a* and 5).

Figure 5:
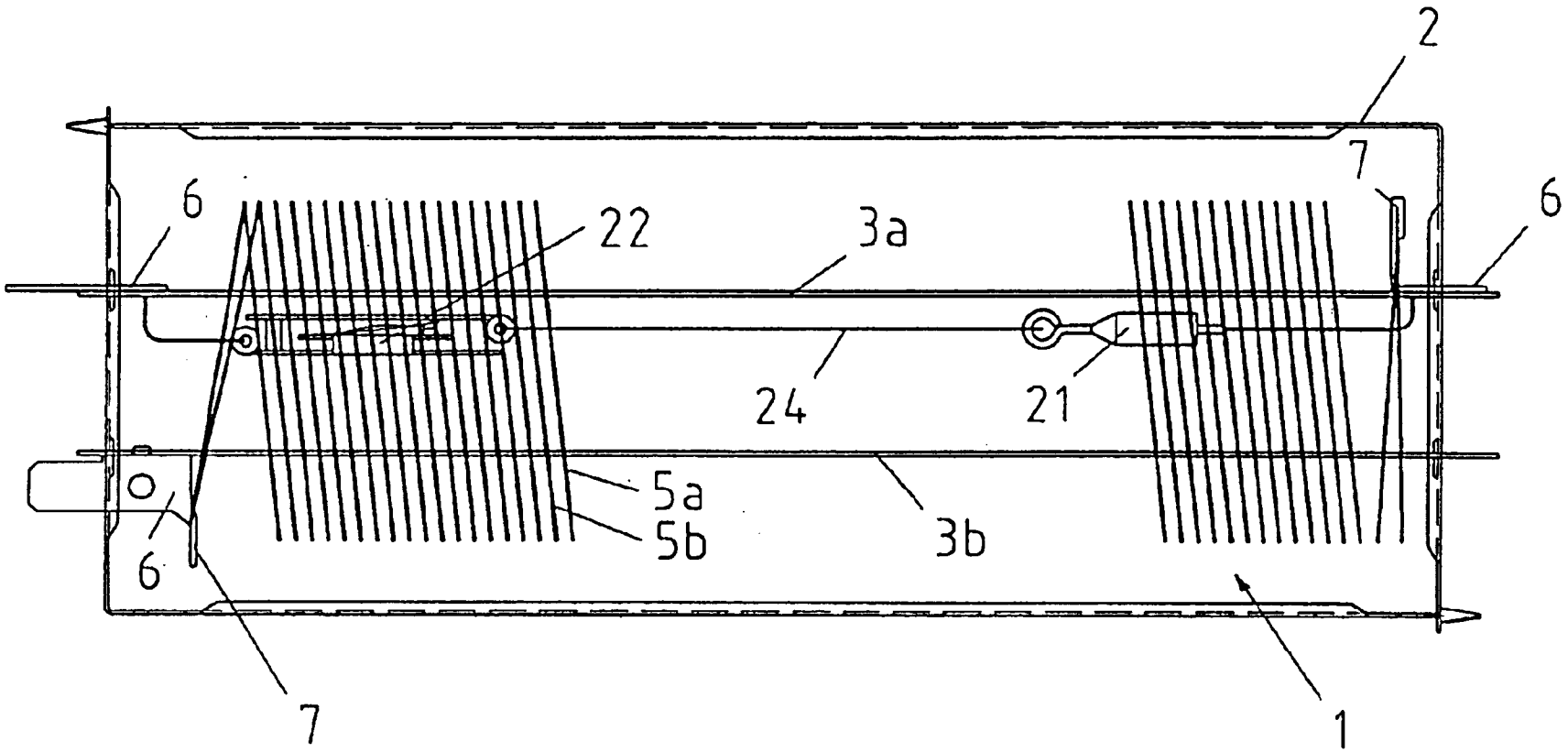
FIG. 5 A front view of an inventive heater with one-sided electric terminals and a return conductor with integrated thermal element between the support plates.

FIG. 5 shows an embodiment of the inventive heater with one-sided terminals on the left-hand side and where a return conductor 24 of the heating wire 5 as a conductive wire connection between the right and left-hand contact part 6 of the upper plate 3*a* and spaced therefrom is passed between the plates 3*a*, 3*b*. A thermal element in the form of a fuse 21 and temperature sensor 22 is integrated into the return conductor 24.

In conjunction with this construction of the return conductor 24, the heating wire 5 wound helically around two plates is particularly advantageous, because there is adequate space between the plates 3*a*, 3*b* for the thermal element 21, 22. Thus, the position of the temperature sensor 22 can be freely chosen. It is obviously constructionally possible with a two-sided connection version to arrange the thermal elements without a simultaneous return conductor function between the plates.

Figure 6:
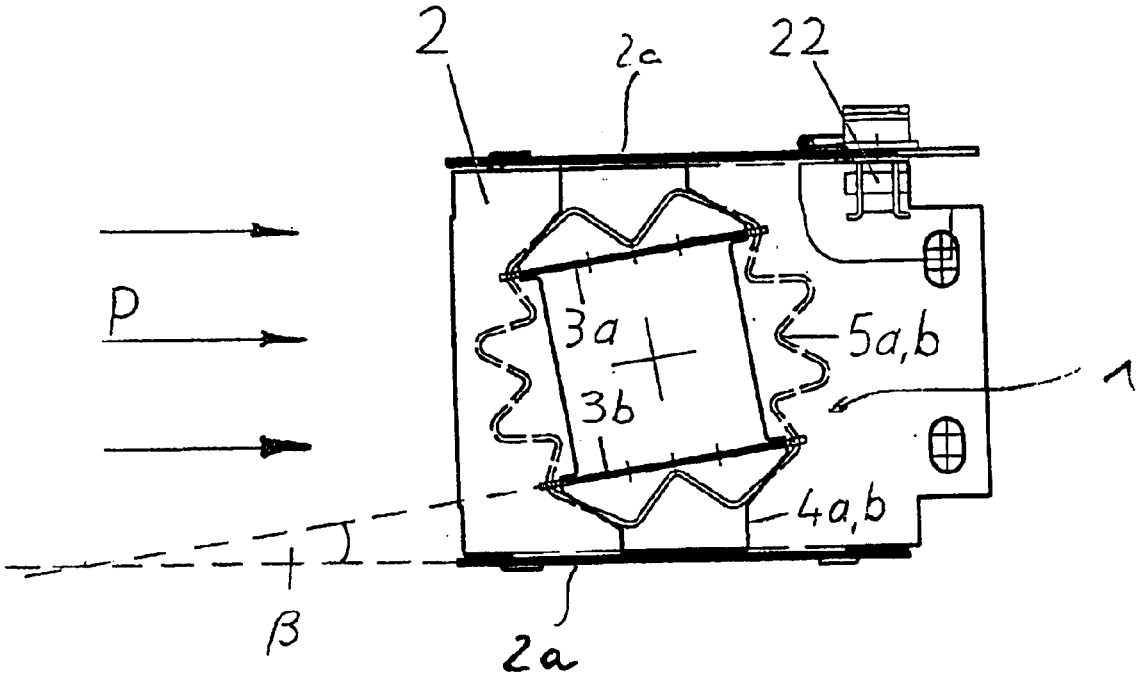
FIG. 6 A section corresponding to FIG. 1*b* relative to a further development.

FIG. 6 shows a cross-section similar to that of FIG. 1*b* with an electric heater 1 arranged in a cross-sectionally rectangular casing 2. The casing 2 has two parallel gas or air guidance walls 2*a*, which are oriented substantially parallel to the gas or air flow P. The heater 1 is arranged in casing 2*a* in such a way that in the flow direction P the support plates 3*a*, 3*b* are inclined to the guide walls 2*a* and in the represented embodiment enclose an angle β of approximately 10°.

What is claimed is:

1. Electric heater for gaseous media with at least one support plate and at least one coil of a corrugated, electric resistance heating wire, which is wound continuously around the support plate and whose turns are held by bend-offs of the heating wire on the longitudinal edges of the support plate, wherein the heating wire is positioned in such a way that it only contacts longitudinal narrow sides and/or edges of the longitudinal narrow sides of the support plate and wherein the heating wire, in the vicinity of a convex bend-off, is guided over the longitudinal narrow sides of the support plate, a bending angle (α) between areas of the heating wire following onto the bend-off on both sides exceeding 40°.

2. Electric heater according to claim 1, wherein the bending angle (α) exceeds 60°.

3. Electric heater according to claim 1, wherein, in addition to the straight flanks placed between wave peaks and corresponding wave troughs, the heating wire has further straight portions, which have a greater length than the flanks.

4. Electric heater according to claim 3, wherein the straight portions are at least twice as long as the flanks.

5. Electric heater according to claim 3, wherein the straight portions extend substantially tangentially to the turns of the coil.

6. Electric heater according to claim 1, wherein, in the case of using a plurality of support plates, in an area between the support plates, the heating wire has a regular wave pattern of wave peaks and wave troughs.

7. Electric heater according to claim 6, wherein, in the transition areas between the straight portions and the corrugated portions, the heating wire is held on the support plates.

8. Electric heater according to claim 7, wherein, between straight portions engaging on facing longitudinal narrow sides, the heating wire has at least one further wave trough, whose apex engages on an outside of the support plate.

9. Electric heater according to claim 6, wherein, between straight portions engaging on facing longitudinal narrow sides, the heating wire has two wave troughs and wherein the heating wire has a substantially M-shaped configuration in a portion between the same.

10. Electric heater according to claim 1, wherein it has a double or multiple coil in the form of at least two, parallel wound heating wires.

11. Electric heater according to claim 1, wherein when using several support plates a temperature or thermal element is provided in an area between the support plates.

12. Electric heater according to claim 1, wherein the support plate has grooves in its longitudinal narrow sides for the insertion of windings of the heating wire.

13. Electric heater according to claim 1, wherein the support plate has openings in the vicinity of the helix.

14. Electric heater according to claim 1, wherein the heating wire has a PTC characteristic.

15. Electric heater according to claim 1, wherein the number of heating wire windings per length unit varies along the support plate.

16. Electric heater according to claim 1, wherein an electrical resistance of the heater can be adapted by means of the extent of a depth of the wave troughs or height of the wave peaks of the heating wire.

17. Electric heater according to claim 1, wherein a return conductor is guided between the support plates when a plurality of the latter is used.

18. Electric heater according to claim 11, wherein two connection sides for the thermal element are formed by the return conductor.

19. Electric heater according to claim 1, wherein a return line is passed over a casing of the heater.

20. Electric heater according to claim 1, wherein the at least one support plate in the flow direction to guide walls of a casing forms an angle not equal to 0 øand smaller than 90°.

* * * * *